United States Patent [19]

Hodges

[11] 4,085,549

[45] Apr. 25, 1978

[54] LENS POLISHING MACHINE

[76] Inventor: Lee R. Hodges, 14073 Passage Way, Largo, Fla. 33540

[21] Appl. No.: 745,073

[22] Filed: Nov. 26, 1976

[51] Int. Cl.[2] ..... B24B 7/00

[52] U.S. Cl. ..... 51/119; 51/58

[58] Field of Search ..... 51/58, 119

[56] References Cited

U.S. PATENT DOCUMENTS

| | | | |
|---|---|---|---|
| 3,732,647 | 5/1973 | Stith | 51/119 |
| 3,838,542 | 10/1974 | Hodges | 51/119 |

*Primary Examiner*—Harold D. Whitehead

*Attorney, Agent, or Firm*—Arthur W. Fisher, III

[57] ABSTRACT

A high speed lens grinding and polishing machine comprising a lap tool holder and a gimbal mounted polishing element disposed at its lower extreme in a spherical bearing permitting a lens blank holder to follow the contour of the lens during the polishing process. Relative movement between the lap tool holder and lens blank holder is generated by a rotary drive operatively coupled to the polishing element and a linear drive operatively coupled to the lens blank holder.

8 Claims, 4 Drawing Figures

LENS POLISHING MACHINE

BACKGROUND OF THE INVENTION

1. Field of the Invention

A high speed lens grinding and polishing machine comprising a lap tool holder and lens blank holder including independent means to provide linear and rotary movement between a lap tool and lens blank.

2. Description of the Prior Art

Numerous devices have been developed for grinding and polishing lens blanks for producing a compound curvature surface. Generally the lens blanks are ground to a predetermined toric shape and then polished with a lap tool having a curvature corresponding with that to be imparted to the finished lens.

In surfacing operations, alignment axes of the lens blank and lap tool is critical. To maintain proper alignment various complex elaborate structures to support the lens blanks and lap tools have been developed. Unfortunately the complexity of such devices present poor lens quality when operating at relatively high speeds. Generally existing machines fall into one of two groups. The first group shows various spring biased operable support shafts in combination with various lens support working tools. These devices disclose grinding and polishing machines employing a biasing spring to urge the work piece and lens upward against the grinding-/polishing tool itself. The second group shows a number of polishing machines including movable linkages or spring biasing means attached to the upper portions of the machines or mechanism which urge the cutting or grinding tool into operative engagement with the lens or mirror surface.

Since the time required to produce a polished surface is dependent upon the relative movement between the lens blank and lap tool existing devices designed for low speed operations are inadequate. Other factors affecting the effective operating speeds are the initial lens blank surface, the pressure applied between the lens blank and the lap tool and the polishing medium.

Present devices and techniques have not been able to meet the increased requirements for more accurate and efficient production methods without sacrifice of lens quality. This is particularly true due to the problems of balance and vibration in the interface between the lens blank and lap tool during high speed operations.

SUMMARY OF THE INVENTION

This invention relates to a high speed lens grinding and polishing machine. More, specifically, this machine comprises a bench or cabinet model housing a high speed lens grinding and polishing machine comprising a lap tool holder and a gimbal mounted polishing element mounted at its lower extreme in a spherical bearing to permit a lens blank holder to follow the contour of the lens during the polishing process. Relative movement between the lap tool holder and lens blank is generated by a rotary drive operatively coupled to the polishing element and a linear drive operatively coupled to the lens blank holder.

The gimbal mounted polishing element comprises a spindle operatively coupled to the rotary drive for rotational movement thereof. The lap tool holder is attached to the upper portion of the spindle to hold a lap tool in operative communication with the lens blank held in place by the lens blank holder. The lower portion of the spindle comprises a spherical bearing housed within the bearing housing. The linear drive, including a lateral drive and longitudinal drive, is attached to the lens blank holder to provide linear movement of the lens blank relative to the lap tool.

An air cylinder is coupled to the lens blank holder to maintain a substantially constant pressure between the lap tool and lens blank during the polishing process. The machine also includes a polishing slurry means to supply a polishing slurry for the lens blank surface during the polishing process.

In operation the spindle and lap tool are driven in a rotary movement through the gimbal assembly by the rotary drive while the lens blank is driven laterally and longitudinally by the linear drive.

Since the machine operates on a true center as opposed to an offset center as with previous machines, the independent movement of the lens blank and lap tool through the rotary drive and linear drive respectively create a smooth, low vibration motion.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the invention reference should be had to the following detailed description taken in connection with the accompanying drawings which.

Similar reference characters refer to similar parts throughout the several views of the drawings.

DETAILED DESCRIPTION OF THE PREFERRED EMBODIMENT

Figure 1:
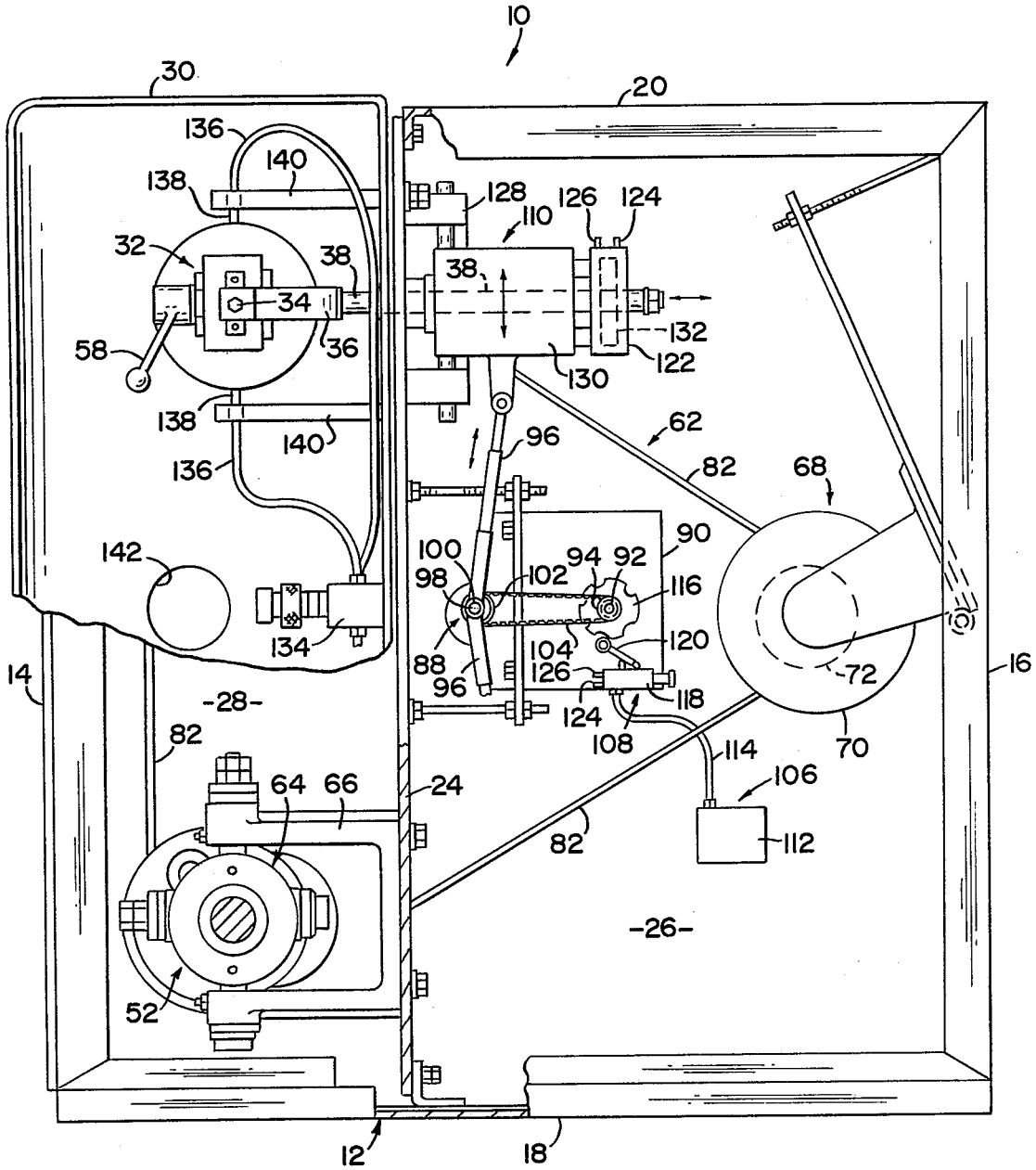
FIG. 1 shows a partial cross-sectional top view of the present invention.
Figure 2:
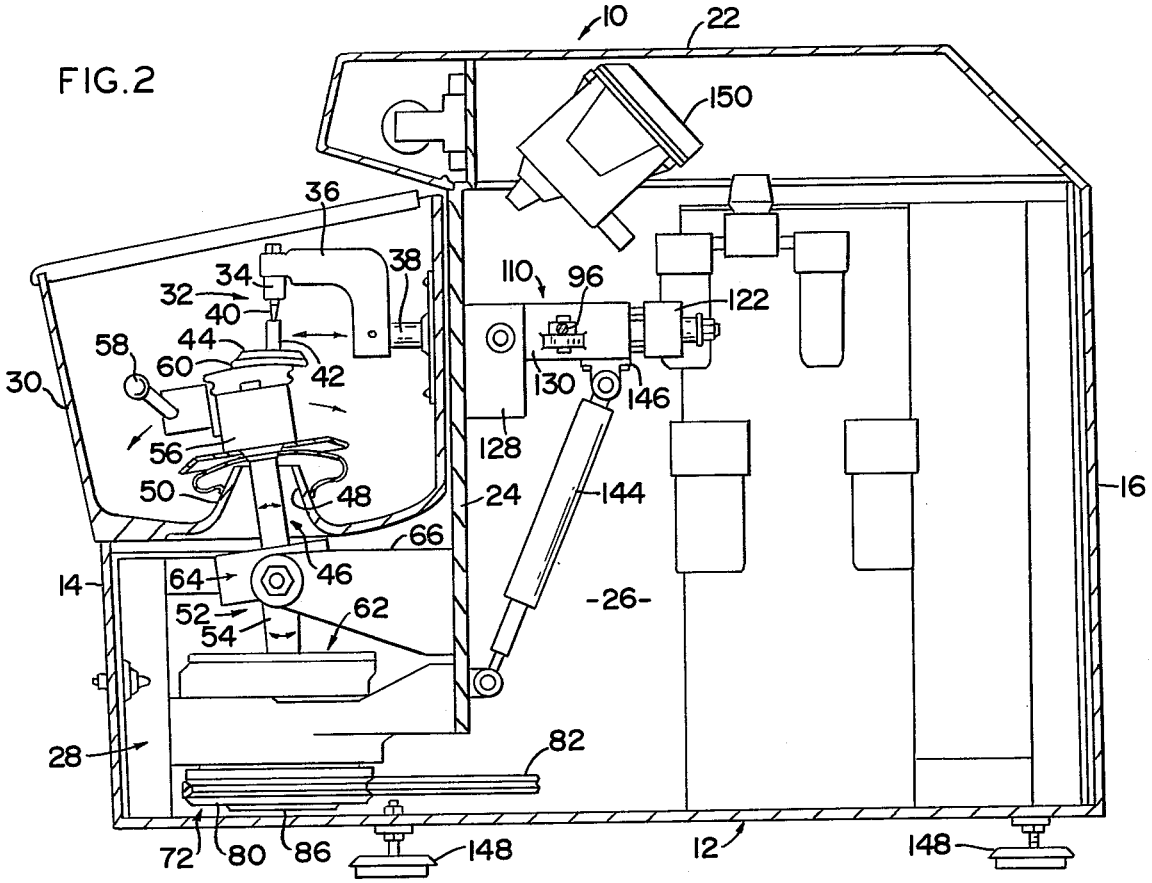
FIG. 2 shows a cross-sectional side view of the present invention.

As shown in FIGS. 1 and 2, this invention comprises a bench or cabinet model high speed lens grinding and polishing machine generally indicated as 10. The machine 10 includes cabinet 12 comprising front and rear panels 14 and 16 respectively, side panels 18 and 20. Pivotally attached to the upper portion of rear panel 16 is cover assembly 22. Extending vertically upward between side panels 18 and 20 is divider panel 24 separating cabinet 12 into enlarged rear enclosure 26 and open forward housing 28. Sink or basin 30 is attached to divider panel 24.

Extending inwardly into the upper portion of sink 30 is lens blank holder generally indicated as 32. Lens blank holder 32 includes pin holder 34 and pin over arm 36 attached to pin holder support or shaft 38 extending through divider panel 24. Pins 40 are fixedly held within pin holder 34 to engage a lens block 42 with a lens blank 44 attached. The pin holder support 38 extends rearwardly through divider panel 24 to the linear drive more fully described hereinafter.

Figure 4:
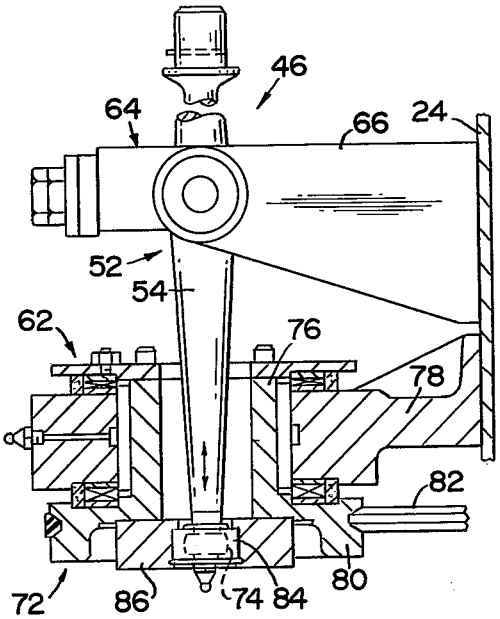
FIG. 4 shows a detailed partial cross-sectional side view of the polishing element of the present invention.

As shown in FIGS. 2 and 4, a lens polishing element, generally indicated as 46 extends upwardly from housing 28 through aperture 48 formed in neck portion 50 of sink 30 and into sink 30. The lower portion of polishing element 46 comprises gimbal assembly 52 and spindle 54. The upper portion of spindle 54 is attached to a lap tool holder 56 including adjustment means 58 to hold lap tool 60 of various sizes within lap tool holder 56. The lower portion of spindle 54 is in operative communication with rotary drive means 62 as more fully described hereinafter. The gimbal assembly 52 comprises a gimbal block assembly 64 operatively connected to a mounting gimbal bracket 66 affixed to divider panel 24 as shown in detail in U.S. Pat. No. 3,838,542.

As best shown in FIG. 1, the rotary drive means 62 includes a primary drive assembly 68 comprising a first motor 70 having a first coupler or pulley 72 attached thereto. As shown in U.S. Pat. No. 3,838,542, the lower portion of spindle 54 terminates in a spherical bearing 74. A sleeve assembly 76 is attached to the divider panel 24 by mounting bracket 78. Coupled to the lower portion of the sleeve assembly 76 is a second coupler or pulley 80. The sleeve assembly 76 is interconnected to the first motor 70 by V belt 82 operatively coupled between first and second couplers 72 and 80 respectively. The spherical bearing 74 is operatively disposed within bearing means 84 within bearing housing 86 coupled to the sleeve assembly 76. As shown, two similar lens polishing elements 46 and gimbal assemblies 52 may be coupled to a single primary drive assembly 66.

Figure 3:
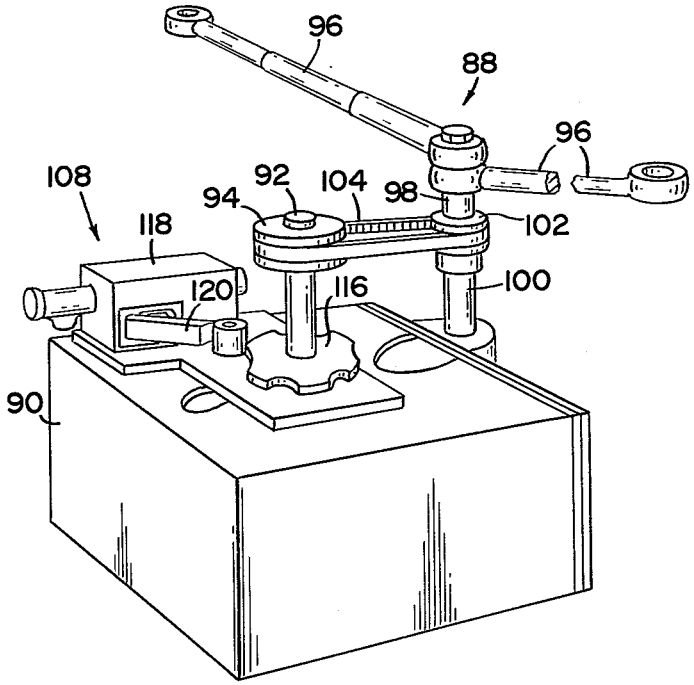
FIG. 3 shows a detailed view of the linear drive of the present invention.

As shown in FIGS. 1 and 3, the linear drive comprises a lateral drive and longitudinal drive. More specifically, the linear drive includes a secondary drive assembly generally indicated as 88 comprising a motor 90 having a drive shaft 92 with a first coupler or pulley 94 attached thereto. The lateral drive comprises a pair of traverse rods 96 attached to an eccentric 98 mounted on shaft 100. The upper portion of drive shaft 92 is coupled to shaft 100 through a second coupler or pulley 102 and gear belt 104. The outer ends of the traverse rods 96 are coupled to the longitudinal drive as described more fully hereinafter. The longitudinal drive comprises a fluid drive means generally indicated as 106, control means generally indicated as 108 and actuator means generally indicated as 110. The fluid drive means 106 comprises a fluid pump or fluid pressure source 112 coupled to the control means 108 through pump intake conduit 114. The control means 108 comprises a cam 116 operatively mounted on the shaft 92, a four-way fluid valve 118 and two position valve control 120. The actuator means 110 further includes a fluid motor 122 in operative communication with the pin holder support 38 and coupled to the fluid valve 118 through actuator intake and discharge conduits 124 and 126 respectively.

The first and second couplers 94 and 102 respectively each comprises a pulley-like member including a plurality of teeth or elements formed about the periphery thereof. As described in the preferred embodiment, the first coupler 94 includes an odd number, 21, of teeth, while second coupler 102 includes an even number, 18, of teeth. As a result, the gear belt 104 coupled therebetween causes shafts 92 and 100 to rotate at different speeds, generating a non-repeating linear motion by producing different cycle times for the lateral drive and longitudinal drive relative to each other.

The actuator means 110 further includes a trunion bracket 128 attached to divider panel 24 having a mounting block 130 pivotally mounted thereon. The fluid motor 122 has a piston 132 disposed therein coupled to the pin holder support 38. The cam 116 is driven by motor 90 causing two position valve control 120 to move alternately between a first and second position. When in the first position, fluid is fed from the fluid pump 112 through the fluid valve 118 to the two fluid motors 122. This forces one piston 132 forward moving the corresponding lens blank holder 32 and lens blank 44 longitudinally relative to the corresponding lap tool holder 56 and lap tool 60. Simultaneously fluid is discharged from the other actuator means 110 forcing the corresponding pistol 132 rearward or inwardly moving the corresponding lens blank 44 in the opposite direction. When the valve control 120 is in the second position under the influence of cam 116, the operation is reversed.

As shown in FIG. 1, the machine also includes polish slurry means to supply a polishing fluid. The polish slurry means comprises a manifold means 134 interconnecting a slurry pump means (not shown) and feed conduit 136. Feed conduit 136 is coupled to nozzle means 138 held in operative communication with lens blank 44 and lap tool 60 by support means 140 attached to divider panel 24. Return drain 142 is formed in the bottom of sink 30 whereby the slurry is recycled to the pump for continuous use.

As shown in FIG. 2, the machine includes a constant pressure means to maintain the pressure between the lens blank 44 and lap tool 60 at an adjustable predetermined pressure during the polishing process. The constant pressure means comprises an air cylinder 144 pivotally connected at one end to plate 146 and at the opposite end to divider panel 24. The air cylinder 144 is operatively connected to a pneumatic source (not shown).

As shown in FIG. 2, the machine also includes leveling means 148 rotatably attached to the cabinet 12 and automatic timer 150 to control the rotary and linear drives and pressure means.

In operation, a lap tool 60 is placed within the adjustable lap tool holder 56 and affixed thereto. A lens blank 44 is then operatively engaged therewith and held in operative position by pins 40 of the lens blank holder 32. The proper pressure between these surfaces is applied by adjusting the pressure of air cylinder 144. The machine 10 may be used for either grinding or polishing. According to whether it is a rough or smooth finish, the pressure is adjusted and the timer 150 is set to automatically run for a predetermined time. Once actuated motor 70 drives spindle 54 in rotary movement relative to pins 40 and lens blank 44 through gimbal assembly 52. The lens blank holder 32 and lens blank 44 are moved laterally relative to lap tool 60 and lap tool holder 56 by the lateral drive through the oscillating motion of the traverse rods 96 coupled between the mounting block 130 and eccentric 98 driven by motor 90 through gear belt 104 through the longitudinal drive as previously described.

The coordinated movement between rotary drive 62 and linear drive comprising the lateral and longitudinal drive, independent of each other provides a unique balanced and low vibration operation.

It will thus be seen that the object made apparent from the preceding description are efficiently attained, and since certain changes may be made in the above construction without departing from the scope of the invention, it is intended that all matter contained in the above description or shown in the accompanying drawing shall be interpreted as illustrative and not in a limiting sense.

It is also understood that the following claims are intended to cover all of the generic and specific features of the invention described herein and all statements of the scope of the invention which as a matter of language, might be said to fall therebetween.

Now that the invention has been described, what is claimed is:

1. A high speed lens polishing machine comprising a cabinet having a polishing element mounted thereon, said polishing element including a spindle and lap tool holder configured to retain a lap tool thereon, a rotary drive attached to said cabinet operatively coupled to said polishing element, a lens blank holder attached to said cabinet, said lens blank holder configured to retain a lens blank thereon, a linear drive including a secondary drive assembly attached to said cabinet operatively coupled to said lens blank holder, said lap tool holder disposed relative to said lens blank holder to hold said lens blank in operative engagement with said lap tool, said rotary drive rotating said lap tool holder and said lap tool relative to said lens blank holder and said lens blank, said linear drive moving said lens blank holder and said lens blank linearally relative to said lap tool holder and said lap tool such that said rotary and linear motion are independent of each other during the polishing process, said linear drive comprising a lateral drive to move said lens blank holder and said lens blank laterally relative to said lap tool holder and said lap tool during the polishing process and a longitudinal drive comprising a fluid drive means, control means operable between a first and second position operatively coupled to said secondary drive assembly and said fluid drive means and an actuator means movable between a first and second position operatively coupled to said control means, said actuator means coupled to said lens blank holder such that as said control means moves from said first position to said second position said actuator means moves from said first position to said second position and as said control means moves from said second position to said first position said actuator means moves from said second position to said first position to move said lens blank holder and said lens blank longitudinally relative to said lap tool holder and said lap tool during the polishing process.

2. The high speed lens polishing machine of claim 1 wherein said lateral drive comprises at least one traverse rod eccentrically coupled to said secondary drive assembly.

3. The high speed lens polishing machine of claim 2 wherein said secondary drive assembly comprises a motor having a first drive shaft and said lateral drive including an eccentric block coupled to the upper portion of said first drive shaft to convert rotary movement of said motor to linear movement of said traverse rod.

4. The high speed lens polishing machine of claim 1 wherein said control means comprises a cam coupled to said secondary drive assembly, a multiple position value control movable between a first and second position in operative communication with said cam and a multiple position fluid valve movable between a first and second position coupled to said multiple position valve control such that said cam alternately moves said multiple position valve control between said first and said second position, said multiple position valve control alternately moving said multiple position fluid valve between said first and second position to move said actuator means between said first and second position.

5. The high speed lens polishing machine of claim 4 wherein said actuator means comprises a fluid motor operatively coupled to said lens blank holder and coupled to said multiple position fluid valve through actuator intake and discharge conduits to alternately move said actuator means from said first to said second position as said multiple position fluid valve moves from said first to said second position as from said second to said first position as said multiple position fluid valve moves from said second to said first position.

6. The high speed lens polishing machine of claim 5 wherein said actuator means further comprises a trunion bracket having a mounting block pivotally mounted thereon, said mounting block being coupled to said lateral drive.

7. The high speed lens polishing machine of claim 3 wherein said secondary drive assembly further includes first coupler attached to said first drive shaft and said lateral drive includes a second coupler coupled to said eccentric block, said first and second couplers being operatively cinterconnected by a continuous belt.

8. The high speed lens polishing machine of claim 7 wherein said first and second couplers each comprises a pulley-like member having a plurality of teeth formed about the periphery thereof and said continuous belt comprises a gear belt, said plurality of teeth of said first coupler being an equal integer and said plurality of teeth of said second coupler having an odd integer such that the rotary motion of said first and second couplers is at a different rate to generate a non-repeating linear motion of said lens blank and said lens blank holder.

* * * * *